US005571065A

United States Patent [19]

Buitoni

[11] Patent Number: 5,571,065

[45] Date of Patent: Nov. 5, 1996

[54] ARM EXTENSION EXERCISE DEVICE

[76] Inventor: Gian L. L. Buitoni, 78 Essex Dr., Tenafly, N.J. 07670

[21] Appl. No.: 505,059

[22] Filed: Jul. 21, 1995

[51] Int. Cl.[6] ..... A63B 22/00

[52] U.S. Cl. ..... 482/74; 482/51; 482/148; 135/71; 135/84

[58] Field of Search ..... 482/74, 75, 76, 482/51, 66, 148; 135/71, 72, 73, 75, 65, 68

[56] References Cited

U.S. PATENT DOCUMENTS

| | | | |
|---|---|---|---|
| 679,468 | 7/1901 | Pratt | 135/84 |
| 765,984 | 7/1904 | Morris et al. | 135/84 |
| 1,348,531 | 8/1920 | Amadio | 135/84 |
| 1,358,643 | 11/1920 | Lamming . | |
| 1,417,250 | 5/1922 | Kelly . | |
| 2,197,279 | 4/1940 | Thorssen . | |
| 2,230,406 | 2/1941 | Johnson | 135/84 |
| 2,241,481 | 5/1941 | Schroeder | 135/72 |
| 2,547,265 | 4/1951 | Hilgeman . | |
| 2,817,348 | 12/1957 | Holliday . | |
| 2,856,943 | 10/1958 | Sparlin | 135/72 |
| 2,861,582 | 11/1958 | Miller . | |
| 3,174,494 | 3/1965 | Maguire, Jr. | 135/71 |
| 3,730,198 | 5/1973 | Johnson et al. . | |
| 4,196,742 | 4/1980 | Owen, Jr. | 135/71 |
| 4,688,789 | 8/1987 | Alter . | |
| 4,869,280 | 9/1989 | Ewing | 135/71 |
| 5,038,811 | 8/1991 | Gilmore | 135/71 |
| 5,458,143 | 10/1995 | Herr | 135/71 |

*Primary Examiner*—Lynne A. Reichard
*Attorney, Agent, or Firm*—Allen N. Friedman

[57] ABSTRACT

This exercise device extends the forearms of a human user to permit running on all fours as an animal runs. The device, usually used as a set of two, is long enough to approximately equalize the user's hip to foot distance and the distance from the user's shoulder to the device's extended end. It has a brace to be grasped by the user's hand with the back of the hand in the forward direction, with an arm embracing member to grasp the elbow end of the forearm, and a forearm support in contact with at least a portion of the wrist end of the forearm at its forward facing surface. The brace is connected to a post. The brace and post are slidable engaged and coupled by a shock absorbing coupling. The outer end of the post terminates in a foot that, during use, permits the brace and post to rotate about an axis perpendicular to the forward direction. The foot may, for example, be hinged to the post, connected to the post by a flat spring, or possess lower surface approximately cylindrical in shape, with a long axis parallel to the axis of rotation. The shock absorbing coupling reduces the impulse transmitted to the user's wrist and shoulder as the foot strikes the ground. The foot may be provided with a removable sole. The foot and/or sole may be replaceable when worn out or to adapt the device to the weather or terrain.

14 Claims, 5 Drawing Sheets

ARM EXTENSION EXERCISE DEVICE

BACKGROUND OF THE INVENTION

1. Field of the Invention

The invention is in the field of exercise devices.

2. Brief Description of the Background Art

During locomotion the human body, particularly the back, is subject to stresses it is not genetically equipped to handle well. Our ancestors walked on four feet and the muscle and connective tissue structure of the back evolved to optimize such locomotion. As a result, four footed animals are not prone to the back problems that plague humans. U.S. Pat. No. 4,655,789, issued Aug. 25, 1987 discloses an exercise method using a pair of arm braces to permit walking or running on all fours to simultaneously exercise the arms and legs without stressing the back. The disclosed arm braces are short crutch-like devices which, like other crutches known in the art are grasped by the user with the back of the hand facing outward, perpendicular to the direction of locomotion. However, this orientation does not simulate the stride of a four legged animal and limits the running speed that can be attained. Merely holding the device disclosed in the above cited patent in the perpendicular orientation does not solve the problem, in part, because of the relative weakness of the human wrist in the reflex direction and the sensitivity of the wrist, elbow and shoulder to the repeated shock of running on all fours.

SUMMARY OF THE INVENTION

The widely practiced exercise of running is effective in promoting the runner's health. However, it stresses the human back in a way that humans are not genetically well equipped to withstand. Any back injury or malformation accentuates the back's sensitivity to this exercise mode. Our genetic ancestors ran on four legs and their muscle set and skeletal framework evolved to accommodate that stance. The exercise device disclosed herein enables a runner to run quickly and easily on all fours without inordinate back stress.

This exercise device extends the forearms of a human user to permit running on all fours as an animal runs. The device, usually used as a set of two, is long enough to approximately equalize the user's hip to foot distance and the distance from the user's shoulder to the device's extended end. It has a brace to be grasped by the user's hand with the back of the hand in the forward direction, an arm embracing member to grasp the elbow end of the forearm, and a forearm support in contact with at least a portion of the wrist end of the forearm at its forward facing surface. The brace is connected to a post. The brace and post are slidable engaged and coupled by a shock absorbing coupling. The outer end of the post terminates in a foot that, when in contact with the ground, permits the brace and post to rotate about an axis perpendicular to the forward direction. The foot may, for example, be hinged to the post, connected to the post by a flat spring, or possess a lower surface approximately cylindrical in shape, with a long axis parallel to the axis of rotation. The shock absorbing coupling reduces the impulse transmitted to the user's wrist and shoulder as the foot strikes the ground. The foot may be provided with a removable sole. The foot and/or sole may be replaceable when worn out or to adapt the device to the weather or terrain.

This inventive device can be constructed in many ways that embody the inventor's novel teachings and are equivalent to the illustrative examples illustrated in the attached figures and described below.

DETAILED DESCRIPTION OF THE INVENTION

Figure 1:
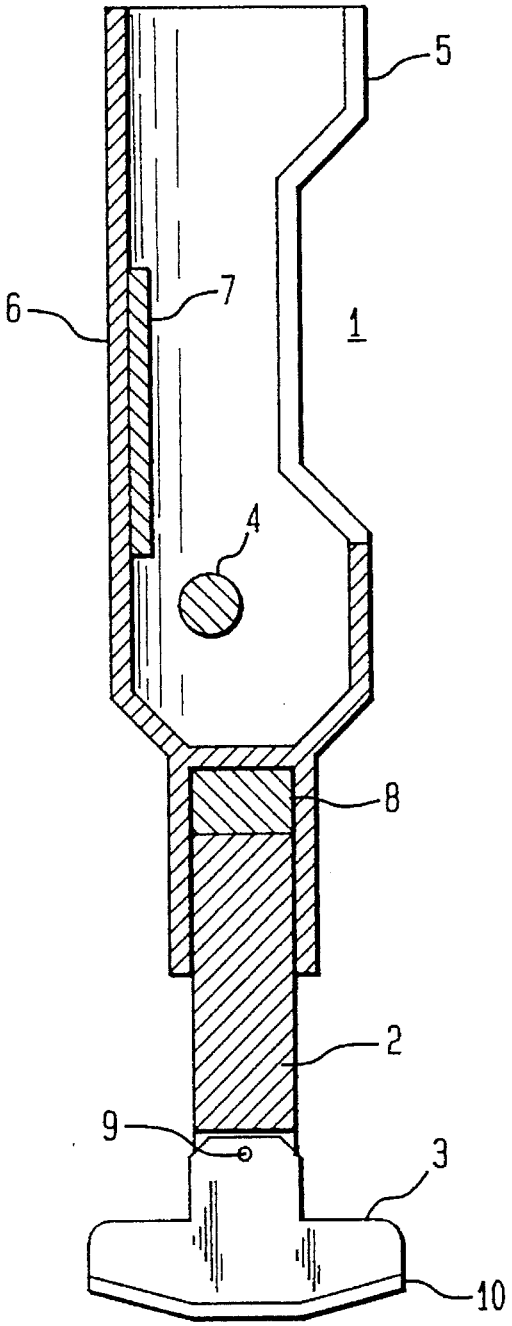
FIG. 1 is a side view, in section, of an exemplary device of the invention.

The exemplary device illustrated in FIG. 1 is shown in a side view with the forward direction toward the left of the figure. The device consists of a brace 1, a post 2, and a foot 3. The user inserts his arm from the top of the brace 1 and grips the hand grip 4, with the back of his hand in the forward direction. The upper end of the brace 1, proximal to the user's elbow, is grasped within an arm embracing member 5. The arm embracing member 5 could either be rigidly dimensioned to precisely fit the user's forearm or could include a spring or strap and closure device to adjustably grasp the forearm. The closure device may be a buckle or a self-adhering fabric such as Velcro® (Velcro is a registered trademark of the American Velcro Corporation). The brace includes a support member 6 extending from the arm embracing member 5 to the brace's distal end. The forward surface of the user's wrist and forearm rests against a wrist support 7 located sufficiently forward of the hand grip 4. The wrist support 7 may be padded for comfort. While it is preferably position to support both the wrist and forearm, it may be position to support at least the lower part of the forearm alone. The hand grip 4 is shown here in cross-section with the axis of the hand grip perpendicular to the surface of the figure and approximately perpendicular to the forward direction.

The distal end of the brace 1 slidable engages the post 2 portion of the device and is connected to the post 2 by a shock absorbing linkage 8. The linkage 8 includes a shock absorbing means such as an elastic body, which may be a spring or a block of elastomeric material, such as a natural or synthetic rubber. This shock absorbing linkage 8 reduces the impulse transmitted to the user as the foot strikes the ground during use. The shock absorbing linkage may, alternatively, include one of the more complex devices (e.g., incorporating elastic and pneumatic elements) known in the art for absorbing shock. The shock absorbing linkage should also be provided with retaining rings, cotter pins, or one of the many other mechanical devices known in the art to prevent disengagement of the post and brace.

The end of the post 2 opposite to the shock absorbing linkage 8 is affixed to a foot 3. The foot 3 is adapted to permit rotation of the brace 1 and post 2 about an axis perpendicular to the forward direction. This is done in the exemplary device of the FIG. 1 by hinging the foot 3 and post 2 for rotation about the hinge pin 9. The hinge pin 9 permits the post 2 to rotate about the foot 3 when the foot 3 is in contact with the ground and to rotate under the influence of gravity as one stride ends and the device 1 is brought forward to start the next stride.

The foot 3 is, preferably, adapted for easy removal when worn or to adapt to changes in weather or terrain, by replacing the foot with a foot having a more suitable sole. In the alternative it is possible to construct a foot 3 in which the sole portion 10 is replaceable while leaving the foot 3 in place.

To operate as an exercise device permitting rapid locomotion, the linkage of the device should be such as the distance between the user's shoulder and the sole portion 10 of the foot 3 is approximately equal to the distance between the user's foot and hip. The distance between the hand grip 4 and the sole portion 10 of the foot 3 is, preferably, adjustable to accommodate to the size and the comfort of the user.

Figure 2:
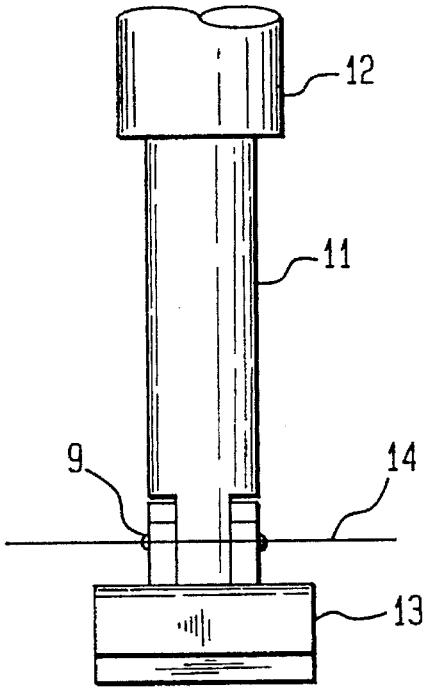
FIG. 2 is a front view of an exemplary post and foot.
Figure 3:
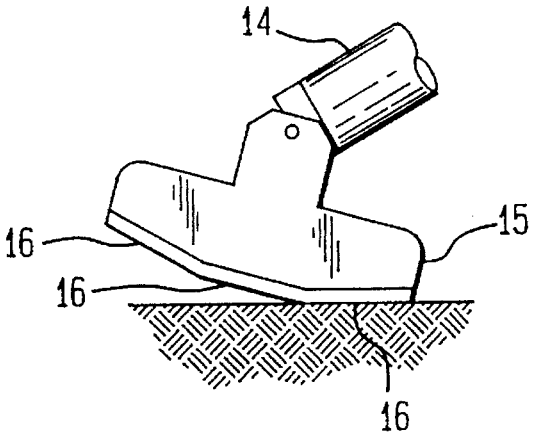
FIG. 3 is a side view of an exemplary post and foot, shown in use.

FIG. 2 shows a front view of the lower portion of the device with the post 11 and the brace 12 being able to rotate about axis 14 with respect to the foot 13. The axis of rotation 14 runs through the hinge pin 9. FIG. 3 shows the post 14 and foot 15 with the device in the forward extended position in which the foot 15 is rotated downward by gravity so that the rear portion of the sole 16 is in contact with the ground.

Figure 4:
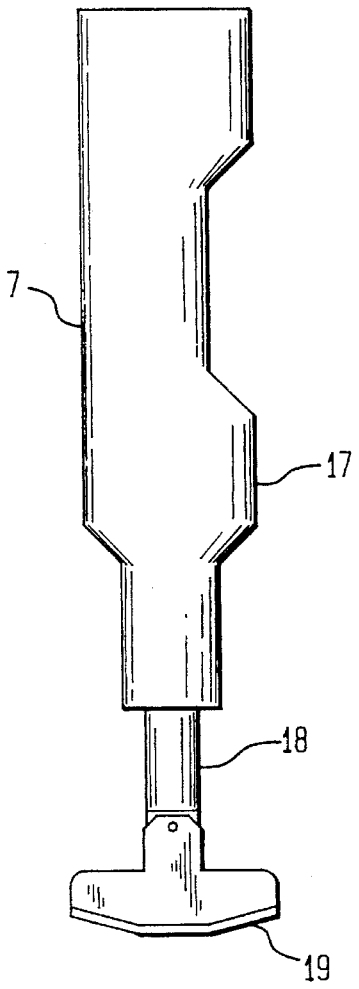
FIG. 4 is a side view of an exemplary device of the invention.
Figure 5:
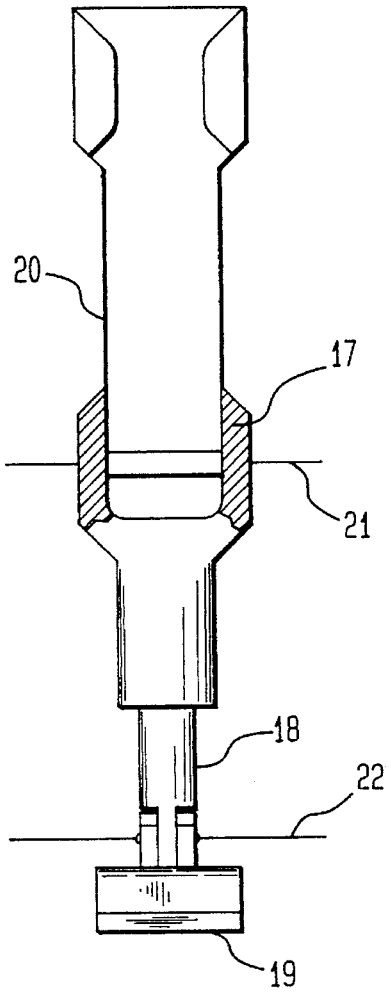
FIG. 5 is a rear view of an exemplary device of the invention.

FIG. 4 shows a side view of an exemplary device of the invention with the forward direction to the left. In this device the arm embracing member 5 and the wrist support 7 are integral with the remainder of the support member 17. The post 18 is slidable engaged with the support member 17 and the foot 19 is hinged at the distal end of the post 18. FIG. 5 is a rear view of the exemplary device of FIG. 4 showing the axis 21 of the hand grip 4 approximately parallel to the axis of rotation 22 of the brace 17 and post 18 about the foot 19.

Figure 6:
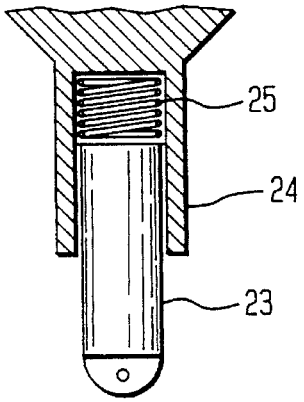
FIG. 6 is a side view, in section, of a portion of the exemplary device of the invention showing a spring linkage.
Figure 7:
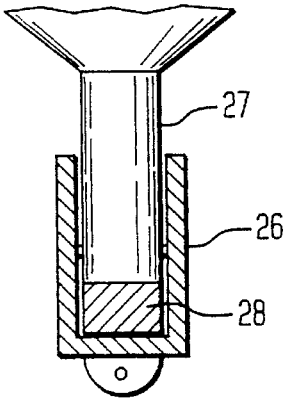
FIG. 7 is a side view, partially in section, showing the lower part of the brace slidable engaged within the post and the shock absorbing linkage consisting of a block of elastomer.

FIG. 6 shows the detail of an exemplary linkage 25 between the support member 24 and post 23. In this exemplary linkage 25 the shock absorbing material is a spring. In FIG. 7 the shock absorbing material in the linkage 28 between the post 26 and support member 27 includes a block of elastic material such as a natural or synthetic rubber and the distal end of the support member 27 slides within the post 26.

Figure 8:
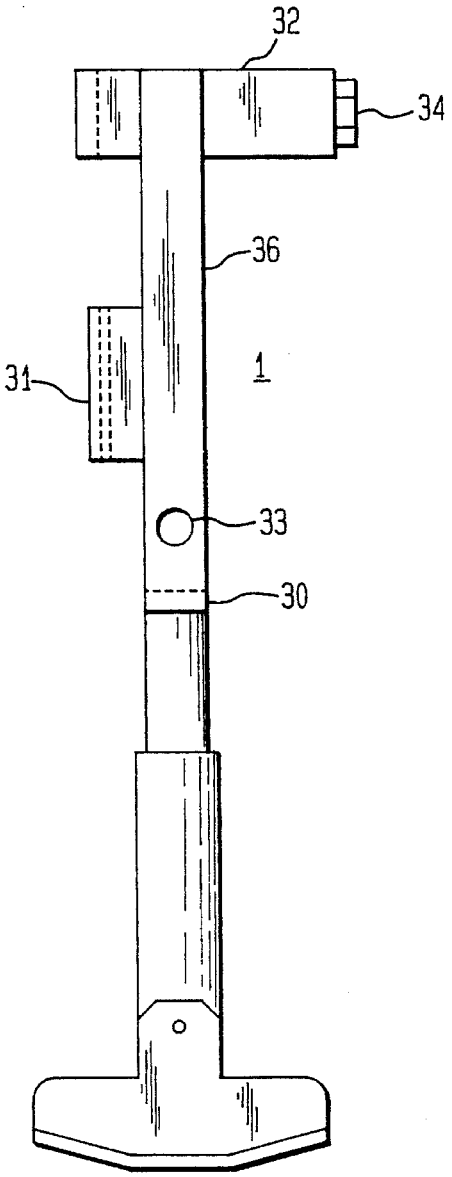
FIG. 8 is a side view of an exemplary device of the invention.

FIG. 8 shows an exemplary device of the invention in which the wrist support 31 and arm embracing member 32 are separately constructed and affixed to the upward extensions of the support member 36, the wrist support 31 being positioned sufficiently forward of and upward of the hands grip 33 to permit the back of the wrist and lower portion of the forearm of the user to be comfortably supported during use.

Figure 9:
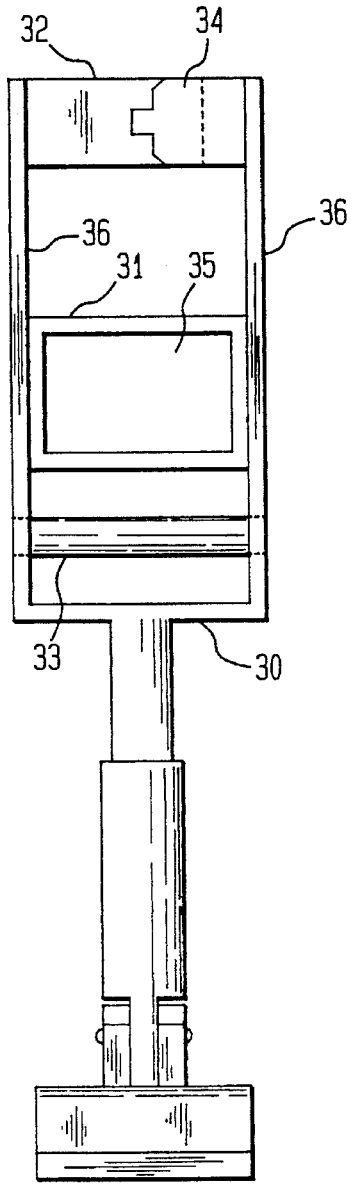
FIG. 9 is a rear view of an exemplary device of the invention.
Figure 10:
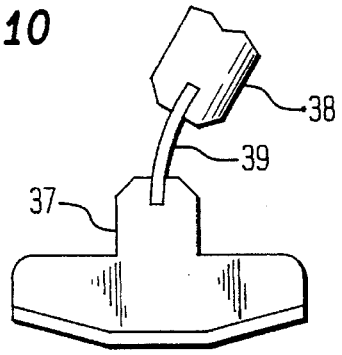
FIG. 10 is a side view of an exemplary post and shoe hinged with a flat spring.

FIG. 9 shows a rear view of the device of FIG. 8, in which the wrist support 31 includes a section of padding 35 for the comfort of the user. The arm embracing member 32 includes an adjustable strap and a closure device 34 such as a buckle or a piece of self-adhesive fabric material (e.g. Velcro). FIG. 10 shows the lower portion of an exemplary device of the invention in which the foot 37 is linked to the post 38 by a flexing element 39 such as a flat spring. This is a side view showing the thin edge of the flat spring 39 flexed to illustrate rotation of the post 38 about the foot 37 along an axis running through the spring and perpendicular to the plane of the figure. This axis is also perpendicular to the forward direction which extends to the left of the figure.

Figure 11:
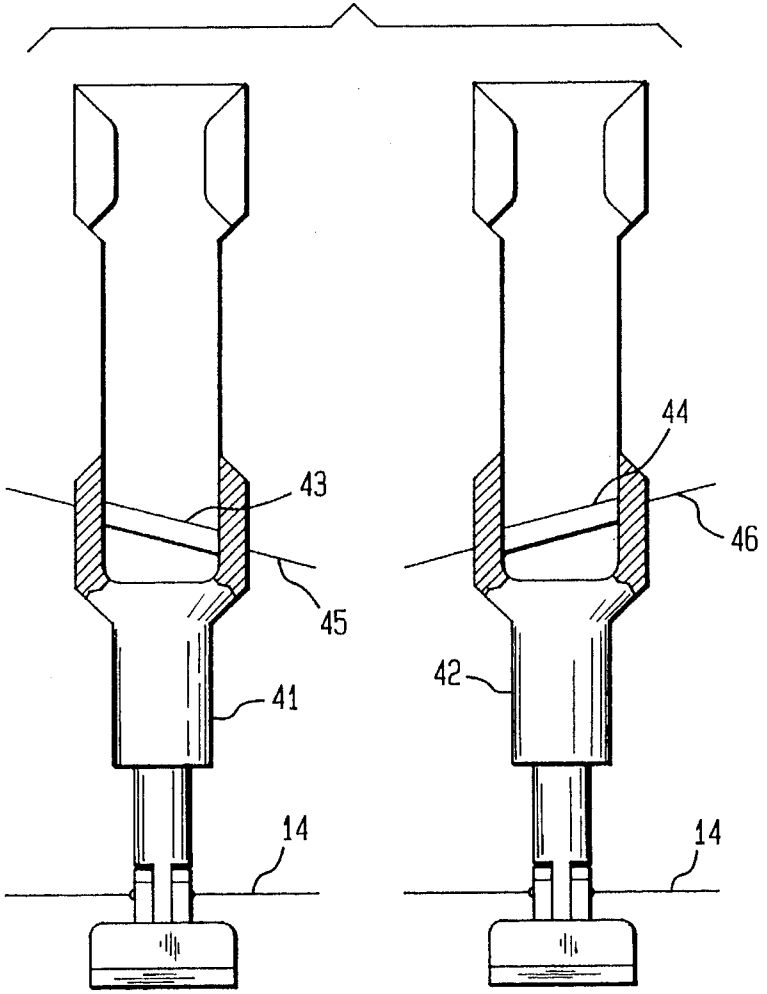
FIG. 11 is a rear view of a pair of exemplary devices of the invention showing the hand grips set an angle to the horizontal.

FIG. 11 illustrates the fact that the inventive device is intended, typically, to be used as a pair of individual devices 41, 42. FIG. 11 also illustrates the fact that it may be more comfortable for the user, to incline the hand grips 43, 44 downward toward the center of the user's body. Thus, the left hand grip 43 may be inclined downward toward the right (clockwise about the forward direction) and the right hand grip 44 may be inclined downward and toward the left (counterclockwise about the forward direction). The axes 45, 46 of the hand grips 43, 44 are inclined from the horizontal (and from the axis of the hinge 14) by an angle, preferably, approximately 20°. However a simple mechanical adjustment may be provided in the support members 41, 42 to permit minor adjustment of this angle, as it suits the comfort of the user.

Figure 13:
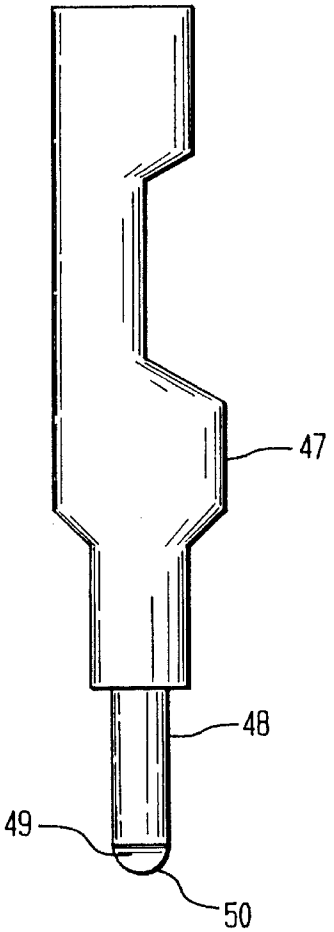
FIG. 13 is a side view of an exemplary device as shown in FIG. 12.
Figure 12:
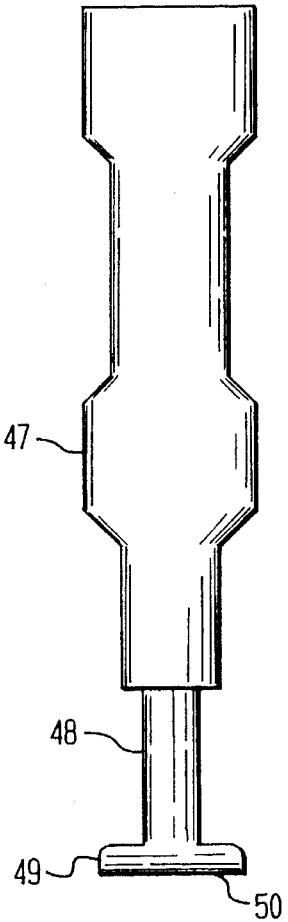
FIG. 12 is a front view of an exemplary device of the invention showing a foot rigidly fixed to the post but shaped to permit rotation of the device about an axis perpendicular to the forward direction.

FIG. 12 shows an exemplary device of the invention in which the post 48 is integral with the foot 49. Rotation of the support member 47 and post 48 about the foot 49 is accomplished by making the sole portion 50 of the foot 49 shaped approximately as a surface of rotation about an axis 51 perpendicular to the forward direction, which runs perpendicular to the plane of the figure. For increased stability during use, the foot 49 is shaped such that its extent parallel to the axis of rotation 51 is significantly greater (by at least three times) than its extent in the forward direction. FIG. 13 shows a side view of the device of FIG. 12.

Figure 14:
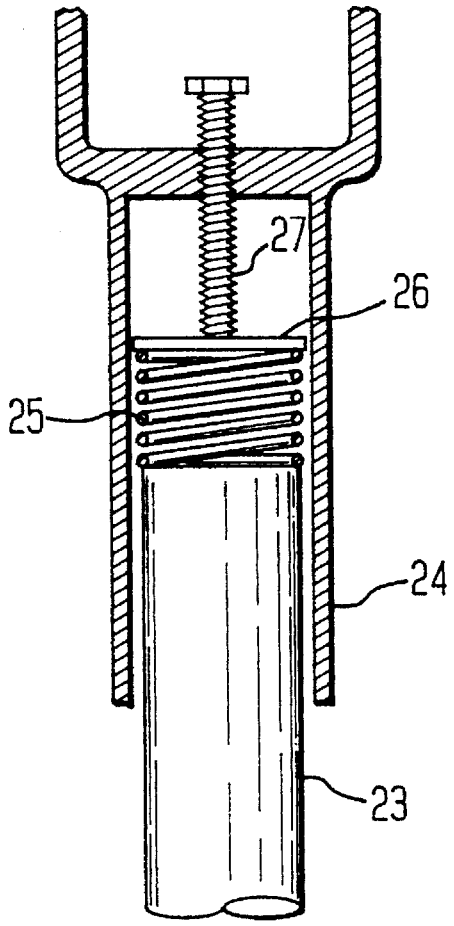
FIG. 14 is an elevational view in section of a portion of an exemplary device of the invention showing the linkage between the post and brace and an exemplary means for adjusting the total length of the device.

FIG. 14 shows an exemplary linkage in which the elastic member 25 rests against a sliding platform 26 that is positioned by a threaded shaft 27. Rotation of the threaded shaft 27 adjusts the overall length of the inventive exercise device. The device length may also be adjusted by changing the length of the post 23, either by substituting a post of different length or by providing one of the many mechanical mechanisms known in the art to adjust the length of a ridged member.

What is claimed is:

1. An exercise device for extending the forearm of a human user to permit running on hands and legs in a forward direction comprising:

a. a brace adapted for supporting the user's forearm, comprising an extended support member with a first end proximal to the user's elbow and a second end distal to the users elbow, an arm embracing member at the first end, adapted for grasping the user's forearm, a hand grip with a first axis approximately perpendicular to the forward direction, fixed in the support member between the first end and the second end, a wrist support fixed in the support member between the hand grip and the first end and positioned forward of the hand grip by a distance sufficient to permit the forward surface of the wrist and at least a portion of the user's forearm to rest in contact therewith;

b. a post slidably engaging the support member at the second end and linked to the support member by a linkage, wherein the linkage comprises a shock absorbing means for reducing the impulse transmitted to the user as the device strikes the ground during use; and c. a foot affixed to the post opposite the linkage and adapted for permitting rotation of the post and the brace about a second axis that is horizontal and approximately parallel to the first axis, when the foot is in contact with the ground.

2. A device of claim 1 in which the arm embracing member includes at least one spring.

3. A device of claim 1 in which the arm embracing member includes an adjustable strap and a closure device.

4. A device of claim 1 in which the wrist support is integral with the support member and extends from the hand grip to the arm embracing member.

5. A device of claim 1 in which the first axis is inclined to the second axis by approximately twenty degrees of clockwise rotation about the forward direction.

6. A device of claim 1 in which the first axis is inclined to the second axis by approximately twenty degrees of counterclockwise rotation about the forward direction.

7. A device of claim 1 in which the shock absorbing means consists essentially of an elastic body.

8. A device of claim 7 in which the elastic body is a spring.

9. A device of claim 7 in which the elastic body consists essentially of an elastomer.

10. A device of claim 1 in which the foot is affixed to the post by means of a joint that is hinged at the second axis.

11. A device of claim 10 in which the foot is adapted for replacement when worn.

12. A device of claim 1 in which the foot comprises a replaceable sole portion.

13. A device of claim 1 in which the foot portion that is adapted for contacting the ground consists essentially of a surface of rotation about the second axis and possesses an extent along the second axis significantly greater than its extent in the forward direction.

14. A device of claim 1 in which the foot is affixed to the post by a flexing element consisting essentially of a flat spring.

* * * * *